US007401668B2

(12) United States Patent
Witman et al.

(10) Patent No.: US 7,401,668 B2
(45) **Date of Patent: *Jul. 22, 2008**

(54) SINGLE CONE ROCK BIT HAVING INSERTS ADAPTED TO MAINTAIN HOLE GAGE DURING DRILLING

(75) Inventors: George Bodo Witman, Sugar Land, TX (US); Peter Wilson, Norman, OK (US); Scott D. McDonough, Houston, TX (US); Michael A. Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/501,472

(22) Filed: Aug. 9, 2006

(65) Prior Publication Data

US 2007/0107946 A1 May 17, 2007

Related U.S. Application Data

(63) Continuation of application No. 10/407,922, filed on Apr. 4, 2003, now Pat. No. 7,100,711.

(60) Provisional application No. 60/375,360, filed on Apr. 25, 2002.

(51) Int. Cl.
*E21B 10/16* (2006.01)

(52) U.S. Cl. ..... 175/331; 175/365; 175/399

(58) Field of Classification Search ..... 175/331, 175/365, 398, 399, 408
See application file for complete search history.

(56) References Cited

U.S. PATENT DOCUMENTS

| | | | | | |
|---|---|---|---|---|---|
| 5,833,021 | A * | 11/1998 | Mensa-Wilmot et al. | .... | 175/433 |
| 6,119,797 | A * | 9/2000 | Hong et al. | ..... | 175/336 |
| 6,161,634 | A * | 12/2000 | Minikus et al. | ..... | 175/331 |
| 6,167,975 | B1 * | 1/2001 | Estes | ..... | 175/331 |
| 7,100,711 | B2 * | 9/2006 | Witman et al. | ..... | 175/331 |

* cited by examiner

*Primary Examiner*—William P Neuder
(74) *Attorney, Agent, or Firm*—Osha Liang, LLP

(57) ABSTRACT

A roller cone drill bit is disclosed which includes a bit body adapted to be coupled to a drill string. A bearing journal depends from the bit body. A single roller cone is rotatably attached to the bearing journal. The roller cone has a plurality of inserts disposed at selected positions about the cone. The journal defines a rotation angle with respect to an axis of rotation of the bit such that the roller cone includes a wall contact zone and a bottom contact zone. At least one of the inserts disposed in the wall contact zone has an extension portion terminating in a substantially planar upper surface.

17 Claims, 8 Drawing Sheets

SINGLE CONE ROCK BIT HAVING INSERTS ADAPTED TO MAINTAIN HOLE GAGE DURING DRILLING

CROSS-REFERENCE TO RELATED APPLICATIONS

This application claims the benefit, pursuant to 35 U.S.C. § 120, as a continuation of U.S. application Ser. No. 10/407,922, which claims priority pursuant to 35 U.S.C. § 119 of U.S. Provisional Application Ser. No. 60/375,360 filed on Apr. 25, 2002, both applications are incorporated herein by reference.

BACKGROUND OF INVENTION

1. Field of the Invention

The invention relates generally to the field of roller cone ("rock") bits used to drill wellbores through earth formations. More specifically, the invention is related to structures for cutting elements ("inserts") used in roller cone bits having a single roller cone.

2. Background Art

Roller cone bits are one type of drill bit used to drill wellbores through earth formations. Roller cone bits include a bit body adapted to be coupled to a drilling tool assembly or "drill string" which rotates the bit as it is pressed axially into the formations being drilled. The bit body includes one or more legs, each having thereon a bearing journal. The most commonly used types of roller cone drill bits include three such legs and bearing journals. A roller cone is rotatably mounted to the bearing journal. During drilling, the roller cones rotate about the respective journals while the bit is rotated. The roller cones include a number of cutting elements, which may be press fit inserts made from tungsten carbide and other materials, or may be milled steel teeth. The cutting elements engage the formation in a combination of crushing, gouging and scraping or shearing action which removes small segments of the formation being drilled. The inserts on a cone of a three-cone bit are generally classified as inner-row insert and gage-row inserts. Inner row inserts engage the bore hole bottom, but not the well bore wall. Gage-row inserts engage the well bore wall and sometimes a small outer ring portion of the bore hole bottom. The direction of motion of inserts engaging the rock on a two or three-cone bit is generally in one direction or a very small limited range of direction, i.e., 10 degrees or less.

One particular type of roller cone drill bit includes only one leg, bearing journal and roller cone rotatably attached thereto. The drilled hole and the longitudinal axis of this type of bit are generally concentric. This type of drill bit has generally been preferred for drilling applications when the diameter of the hole being drilled is small (less than about 4 to 6 inches [10 to 15 cm]) because the bearing structure can be larger relative to the diameter of the drilled hole when the bit only has one concentric roller cone. This is in contrast to the typical three-cone rock bit, in which each journal must be smaller relative to the drilled hole diameter.

An important performance aspect of any drill bit is its ability to drill a wellbore having the full nominal diameter of the drill bit from the time the bit is first used to the time the cutting elements are worn to the point that the bit must be replaced. This a particular problem for single cone bits because of the motion (trajectory) of the cutting elements as they drill the wellbore. Essentially all but a few centrally positioned cutting elements on the cone eventually engage the wellbore wall at the gage diameter. The inserts on a single cone bit go through large changes in their direction of motion, typically anywhere from 180 to 360 degrees. Such changes require special consideration in design. The inserts on a single cone bit undergo as much as an order of magnitude more shear than do the inserts on a conventional two or three cone bit. Such amounts of shear become apparent when looking at the bottom hole patterns of each type of bit. A single cone bit creates multiple grooves laid out in hemispherically-projected hypotrochoids, a configuration similar to ink paths generated by drawing instruments in a toy sold under the trade mark SPIROGRAPH by Tonka Corp., Minnetonka, Minn. 55343. A two or three cone bit, in contrast, generates a series of individual craters or indentations. Shearing rock to fail it will typically cause more wear on an insert than indenting an insert to compressively fail rock. Therefore, the inserts on a single cone bit wear faster than the inserts on a two or three cone bit. As the cutting elements on a single cone bit wear, therefore, the drilled hole diameter reduces correspondingly.

One way to maintain full drilled diameter in a single cone bit is to include fixed cutters on the bit body. The fixed cutters may be tungsten carbide inserts. Typically, the fixed cutters will be affixed to the bit body at a position axially above the roller cone on the bit. A single cone bit known in the art which includes the foregoing features is described in U.S. Pat. No. 6,119,797 issued to Hong et al. The bit shown therein includes special inserts in an "intermittent contact zone" on the roller cone, and both active and passive gage protection inserts or buttons on the bit body axially above the roller cone.

While the bit described in the Hong et al. '797 patent is effective in maintaining full diameter of the drilled hole, using fixed cutters as described increases the "gage length" of the drill bit. This may lessen the ability of such a bit to be used in directional drilling applications. Directional drilling includes drilling the wellbore along a selected trajectory, typically other than vertical. Having fixed cutters and/or gage pads on the bit body also increases the torque required to turn the bit, which is not desirable, and in some cases limits the rotary speed that the bit can be turned, leading to reduced drilling rates.

It is therefore desirable to have a single cone rock bit which can better maintain full gage diameter during its useful life, while remaining useful in directional drilling applications.

SUMMARY OF INVENTION

One aspect of the invention relates to a roller cone drill bit which includes a bit body adapted to be coupled to a drill string. A bearing journal depends from the bit body. A single roller cone is rotatably attached to the bearing journal. The roller cone has a plurality of inserts disposed at selected positions about the cone. The journal defines a rotation angle with respect to an axis of rotation of the bit such that the roller cone includes a wall contacting zone and a bottom contact zone. At least one of the inserts disposed in the wall contact zone. has an extension portion terminating in a substantially planar upper surface.

In some embodiments, the extension portion defines a tapered profile. In some embodiments, the tapered profile includes a concave profile part which contacts the upper surface. In some embodiments, the tapered profile includes a convex portion. In some embodiments, the extension portion and the upper surface define an elliptical cross section.

Another aspect of the invention relates to a roller cone drill bit which includes a bit body adapted to be coupled to a drill string, a bearing journal depending from the bit body and a single roller cone rotatably attached to the bearing journal. The roller cone has a plurality of inserts disposed at selected positions thereon. The journal defines a rotation angle with respect to an axis of rotation of the bit such that the roller cone includes a wall contacting zone and a bottom contact zone thereon. At least one of the inserts disposed in the wall contacting zone has a super hard material wafer disposed in an upper surface thereof.

Other aspects and advantages of the invention will be apparent from the following description and the appended claims.

DETAILED DESCRIPTION

Figure 1:
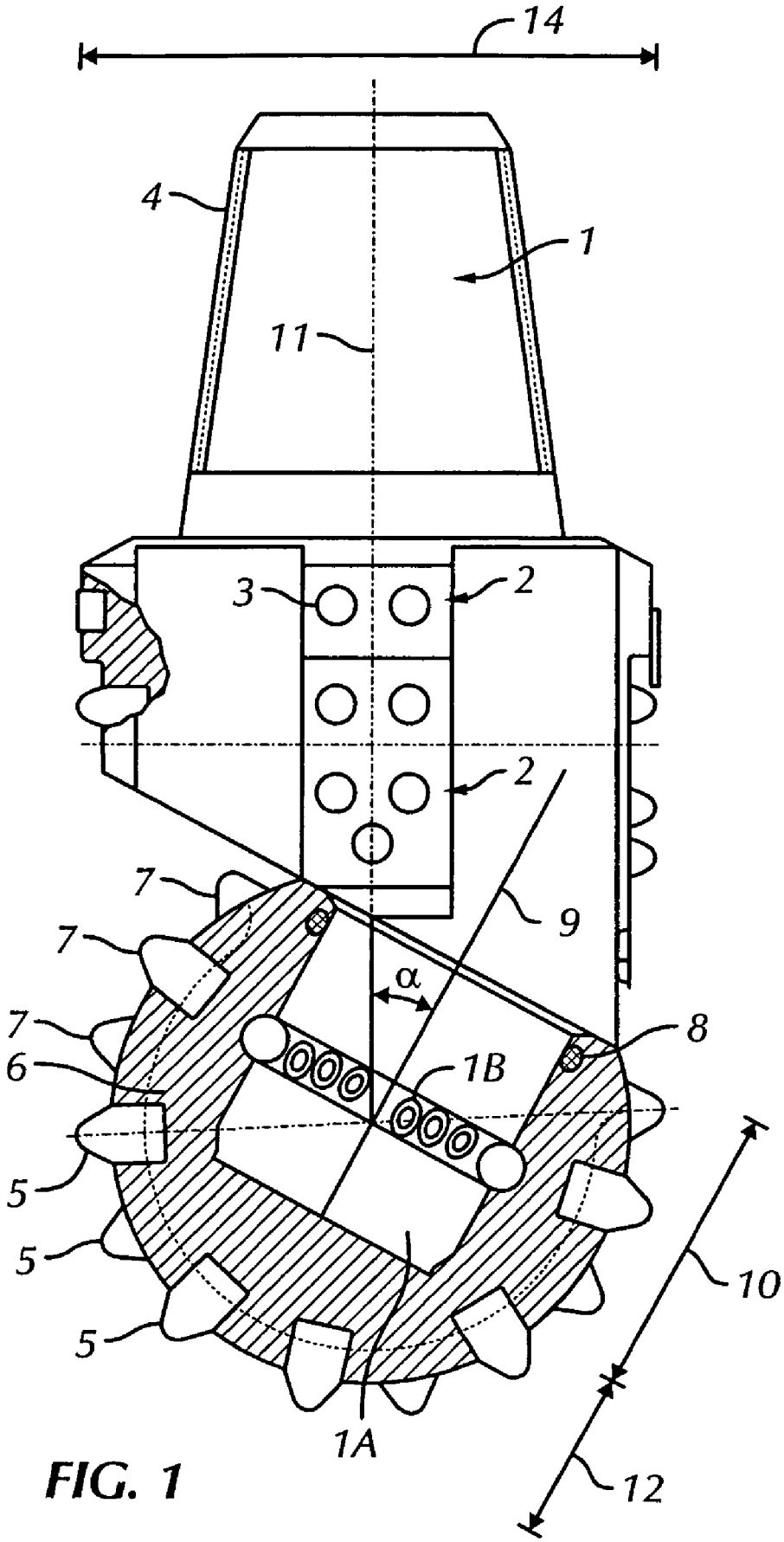
FIG. 1 shows a generalized cut away view of a single cone bit.

A general structure for a single cone roller cone bit which can be made according to various embodiments of the invention is shown in cut away view in FIG. 1. The bit includes a bit body 1 made of steel or other high strength material. The bit body 1 includes a coupling 4 at one end adapted to join the bit body 1 to a drill string (not shown) for rotating the bit during drilling. The bit body 1 may include gage protection pads 2 at circumferentially spaced apart positions about the bit body 1. The gage protection pads 2 may include gage protection inserts 3 in some embodiments. The gage protection pads 2, if used, extend to a drill diameter 14 of the bit.

The other end of the bit body 1 includes a bearing journal 1A to which a single, generally hemispherically shaped roller cone 6 is rotatably mounted. In some embodiments the cone 6 may be locked onto the journal 1A by locking balls 1B disposed in corresponding grooves on the outer surface of the journal 1A and the interior surface of the cone 6. The means by which the cone 6 is rotatably locked onto the journal 1A is not meant to limit the scope of the invention. The cone 6 is formed from steel or other high strength material, and may be covered about its exterior surface with a hardfacing or similar material intended to reduce abrasive wear of the cone 6. In some embodiments, the cone 6 will include a seal 8 disposed to exclude fluid and debris from entering the space between the inside of the cone 6 and the journal 1A. Such seals are well known in the art.

The cone 6 includes a plurality of cutting elements thereon at selected positions, which in various embodiments of the invention are inserts 5, 7 generally interference fit into corresponding sockets (not shown separately) in the outer surface of the cone 6.

The journal 1A depends from the bit body 1 such that it defines an angle $\alpha$ between the rotational axis 9 of the journal 1A and the rotational axis of the bit 11. The size of this angle $\alpha$ will depend on factors such as the nature of the earth formations being drilled by the bit. Nonetheless, because the bit body 11 and the cone 6 rotate about different axes, the motion of the inserts 5, 7 during drilling can be roughly defined as falling within a wall contacting zone 10, in which the insert 7 located therein at least intermittently contact the outer diameter (wall) of the wellbore, and a bottom contact zone 12, in which the inserts 5 located therein are in substantially continuous contact with the earth formations, and generally do not contact the outer diameter (wall) of the wellbore during drilling. The inserts 7 in the wall contacting zone 10 therefore define the drill diameter 14 of the bit. By having inserts for the wall contacting zone 10 which minimize axial wear, but maintain suitable cutting action against the formations being drilled, the life of the bit can be extended, while having relatively high penetration rates.

The inserts 5, 7 may be made from tungsten carbide, other metal carbide, or other hard materials known in the art for making drill bit inserts. The inserts 5, 7 may also be made from polycrystalline diamond, boron nitride or other super hard material known in the art, or combinations of hard and super hard materials known in the art.

Various embodiments of this aspect of the invention include at least one insert 7 in the wall contacting zone 10, and preferably substantially all the inserts 7 therein to be configured such that an uppermost surface of the insert 7 is substantially planar. In some embodiments, an outer surface of an extension portion of the insert 7 presents a substantially flat or a concave profile to the formation during drilling. For purposes of the invention, substantially planar may include a radius of curvature on the upper surface of at least 25 percent of the diameter of the wellbore drilled by the bit. In some embodiments, substantially all the inserts 5, 7 may have a substantially planar upper surface, according to that described above and to other configurations which will be further explained, in order to improve drilling efficiency.

In some embodiments the upper surface has a convex radius of curvature between about 25 and 50 percent of the wellbore diameter, and more preferably being equivalent to the radius of the wellbore diameter or bit diameter.

Figure 2:
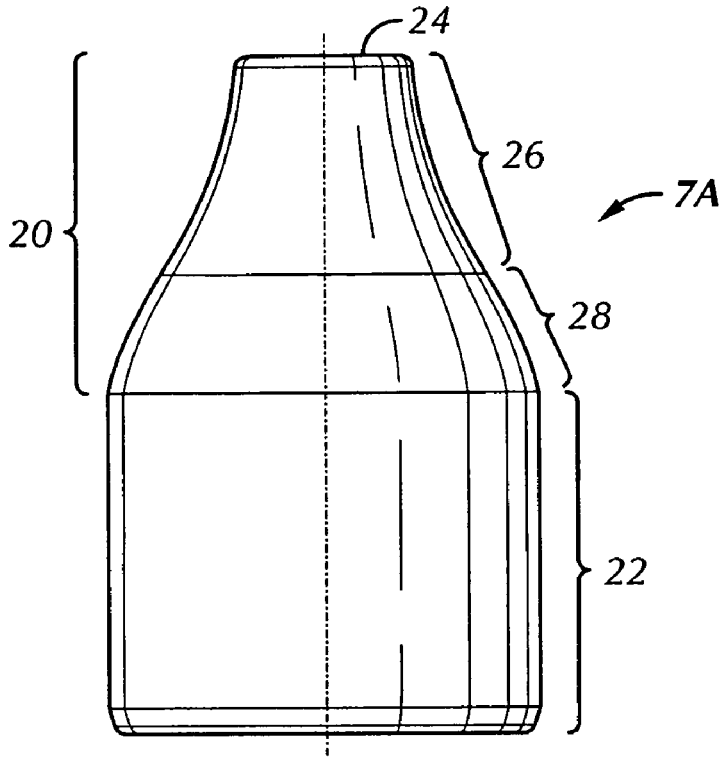
FIG. 2 shows one embodiment of a cutting element according to the invention.

One embodiment of the inserts is shown in FIG. 2. This embodiment of the inserts 7A includes a generally cylindrical body portion 22 which is press fit or otherwise affixed in a corresponding socket (not shown) in the cone (6 in FIG. 1). A generally tapered extension portion 20 of the insert 7A extends from the body portion 20 and terminates in a substantially planar upper surface 24. Just below the upper surface 24 is a concave profile tapered portion 26. In this embodiment, the concave profile portion 26 may be followed by a convex profile tapered portion 28. It is expected that inserts placed in the wall contact portion (10 in FIG. 1) having a substantially planar upper surface 24, and preferably a concave portion 26 below can have improved drilling penetration rates, while increasing life of the drill bit through reduced loss of gage diameter.

Figure 3:
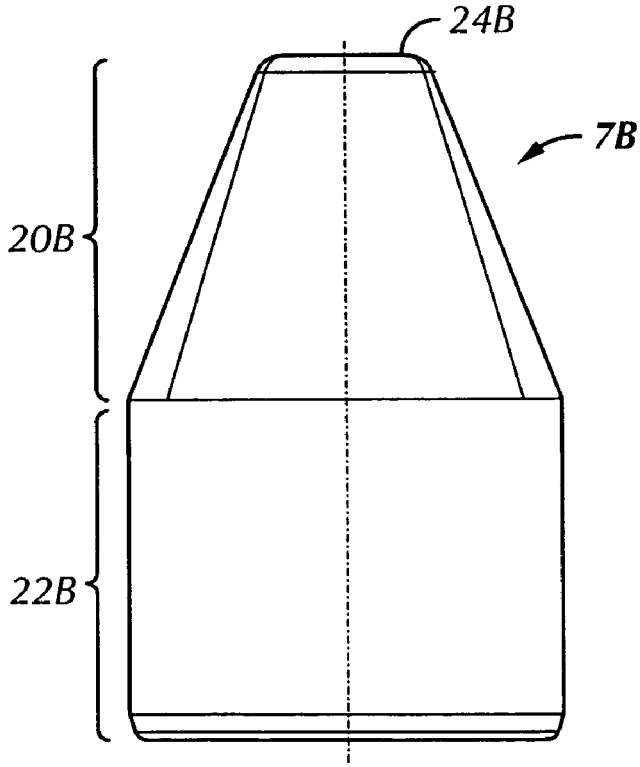
FIG. 3 shows another embodiment of a cutting element according to the invention.

Another embodiment of the insert is shown in FIG. 3. This insert 7B includes a generally cylindrical body portion 22B as in the previous embodiment.

Figure 4:
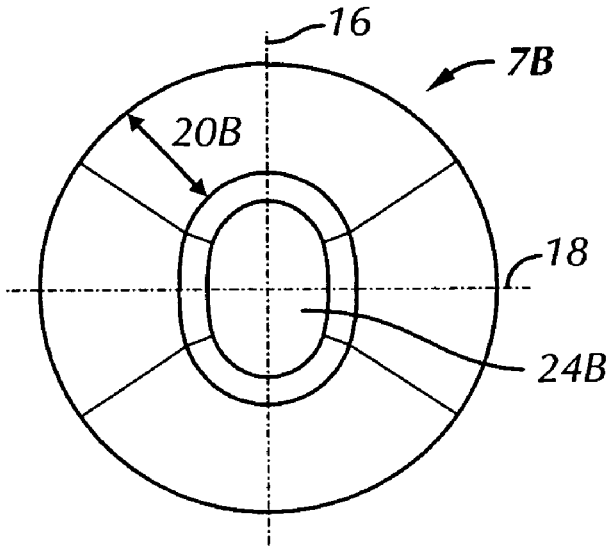
FIG. 4 shows an end view of the insert of FIG. 3.

The generally tapered extension portion 20B and substantially planar upper surface 24B define an elliptical cross-section. The elliptical cross-section is more clearly observable in FIG. 4, which is a top view of the insert 7B. The upper surface 24B forms the termination of the extension portion 20B. Both the extension portion 20B and upper surface 24B define a major axis 16 and minor axis 18. In the embodiment of FIGS. 3 and 4, the taper on the extension portion 20B defines a substantially flat profile.

Figure 5:
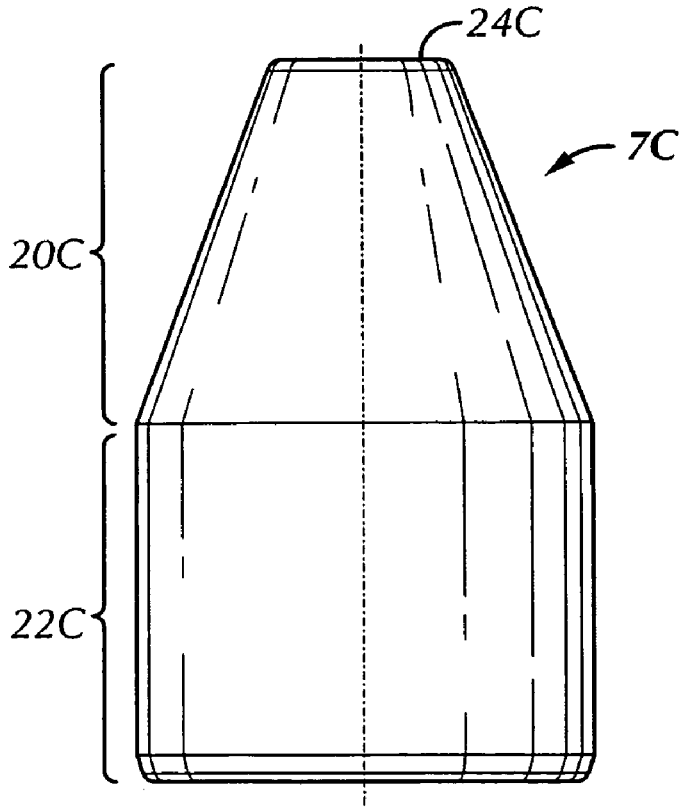
FIG. 5 shows another embodiment of a cutting element according to the invention.
Figure 6:
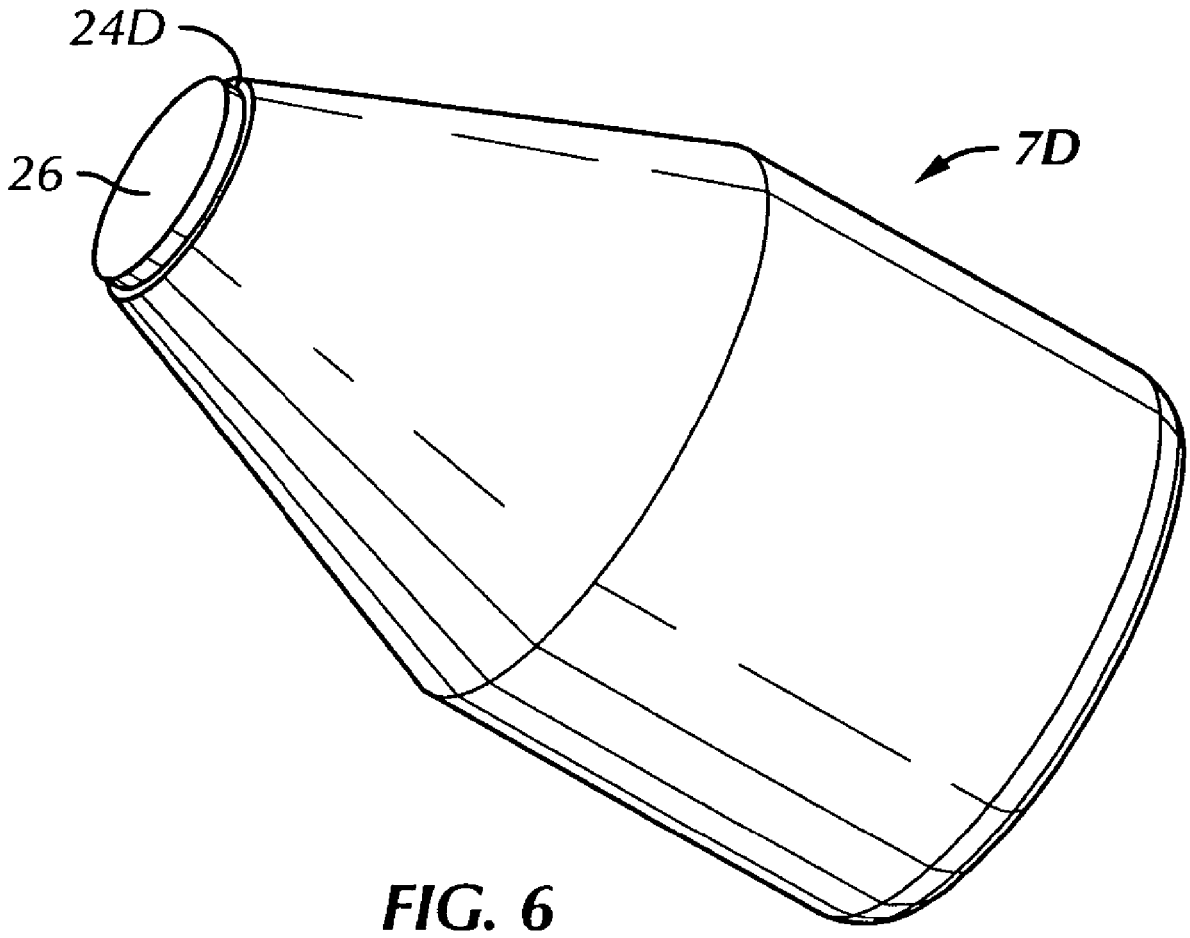
FIG. 6 shows another embodiment of a cutting element according to the invention.

Another embodiment of the insert is shown in FIG. 5. This embodiment includes a substantially cylindrical body portion 22C, and a substantially flat-profile, tapered extension portion 20C which terminates in a substantially planar upper surface 24C. Some embodiments, such as shown in FIG. 6, may include a disk 26 affixed to the upper surface 24D made form super hard material such as polycrystalline diamond, boron nitride or other super hard material.

Figure 12:
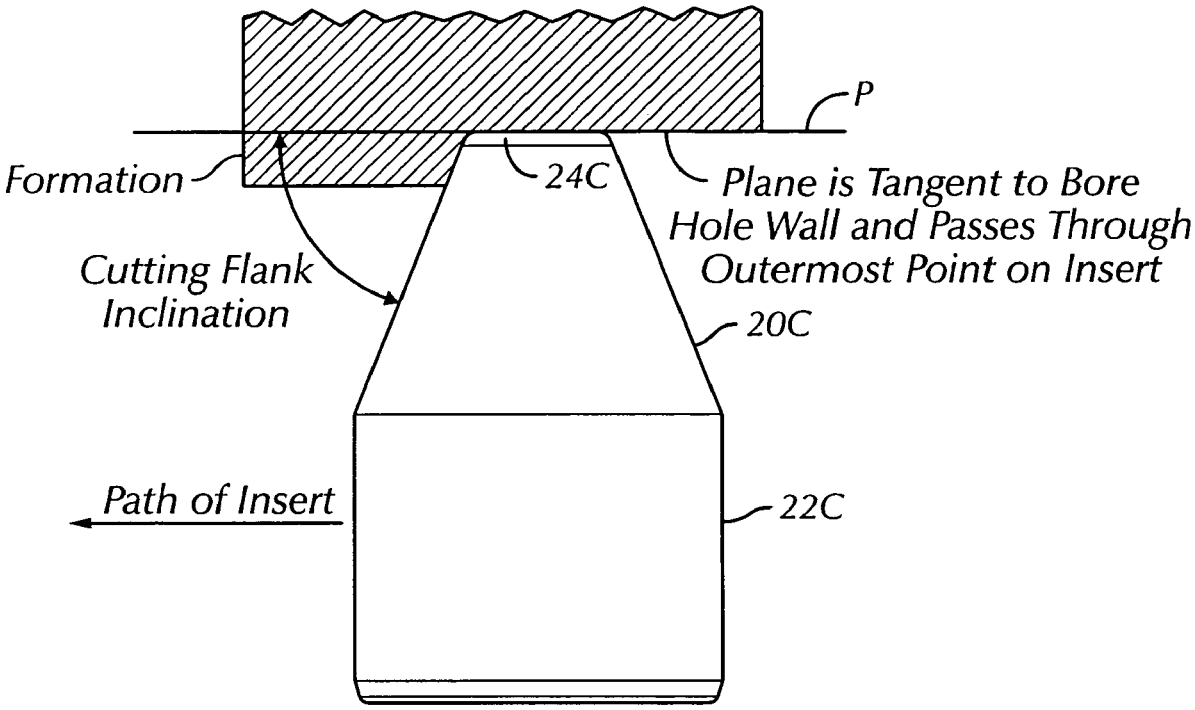
FIG. 12 shows a definition of cutting flank angle.

As shown in FIG. 12, the taper in some embodiments is such that the tapered portion 20C near the upper surface 24C subtends an angle in a range of about 50 to 110 degrees with respect to a plane P tangent to the wellbore wall and passing through an outermost point of contact of the insert. This angle may be referred to as the "cutting flank inclination". More preferably, the cutting flank inclination is about 70 degrees near the upper surface 24C. Cutting flank inclination is related to cutting efficiency and insert durability. Small cutting flank inclination (i.e. 50 degrees) has the effect of increasing durability, as is typically required in hard rock drilling. Large cutting flank inclination angles (i.e. 110 degrees) provide the bit with high rock shearing efficiency, as is useful for drilling soft rock. Rock shearing efficiency and insert durability are generally inversely related. For inserts with an axisymmetric extension portion 20C, the cutting flank inclination angle is generally the same irrespective of the orientation of the insert.

It is known in the art that inserts on a single cone bit can go through a 360 degree change in the direction of motion, with the amount of time at each direction of motion not being equal. Therefore it is desirable to have an insert that has a "cutting flank rake angle", θ, adapted to optimize the efficiency of the inserts based on their trajectory for cutting the borehole. An example of such an insert is shown in FIGS. 11A through 11D. In the insert shown in these figures, the upper surface 24 is positioned so that the insert is not axisymmetric. The result is that the cutting flank angle θ is related to the rotary position about the insert. In some embodiments, the cutting flank rake angle is in a range of between about zero and 40 degrees. The angle at any rotary orientation, of course, depends on the particular rotary orientation. The insert shown in FIGS. 11A through 11D does have a plane of symmetry, however, other embodiments of this type of insert may have no such symmetry.

Generally speaking, various embodiments of inserts to be used with a single cone rock bit according to one aspect of the invention have a substantially planar upper surface, and an extension portion having a flat or at least partially concave profile. The profile of the extension portion in some embodiments is generally tapered. In some embodiments, the extension portion profile is substantially perpendicular to the upper surface. Preferably, the juncture of the upper surface and the extension portion is not gradually radiused, but instead forms a relatively sharp transition between the upper surface and the extension portion with a maximum 0.06 inch radius or is chamfered. Using a larger radius or forming chamfer larger than 0.06 inches is believed to reduce the cutting efficiency as well as unnecessarily reduce the amount of material near the upper surface (24C in FIG. 12) thus reducing the overall insert wear resistance. It is believed that bits made according to this aspect of the invention will maintain gage diameter for longer periods, and rates of penetration can be improved as compared with prior art single cone rock bits.

Figure 7:
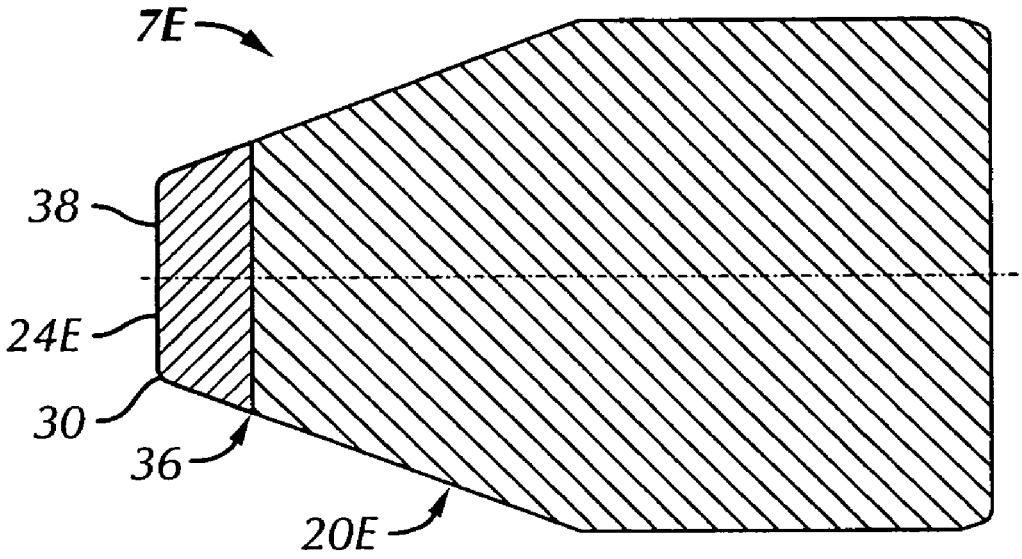
FIG. 7 shows an embodiment of a cutting element according to another aspect of the invention.

One embodiment of another aspect of the invention is shown in FIG. 7. In this aspect of the invention, at least one insert is disposed in the roller cone (6 in FIG. 1) in the wall contact portion (10 in FIG. 1). The insert 7E shown in FIG. 1 includes a generally cylindrical body portion (not shown) similar to that of the other embodiments described herein, and an extension portion 20E which terminates in an upper surface 24E. The extension portion 20E also contains a base 36 which is adapted to mount or bond a super hard material wafer 30 thereon. The wafer 30 can be formed from polycrystalline diamond, boron nitride or other super hard material known in the art. The upper surface 38 of the wafer 30 is substantially planar in this embodiment. The extension portion 20E in this embodiment has a substantially flat profile, but may in some configurations include a concave part (not shown) such as shown in and described with respect to FIG. 2. Various embodiments of this aspect of the invention may also include a profile on the extension portion which is substantially perpendicular to the upper surface 24E, such as would form a right cylinder.

Figure 8:
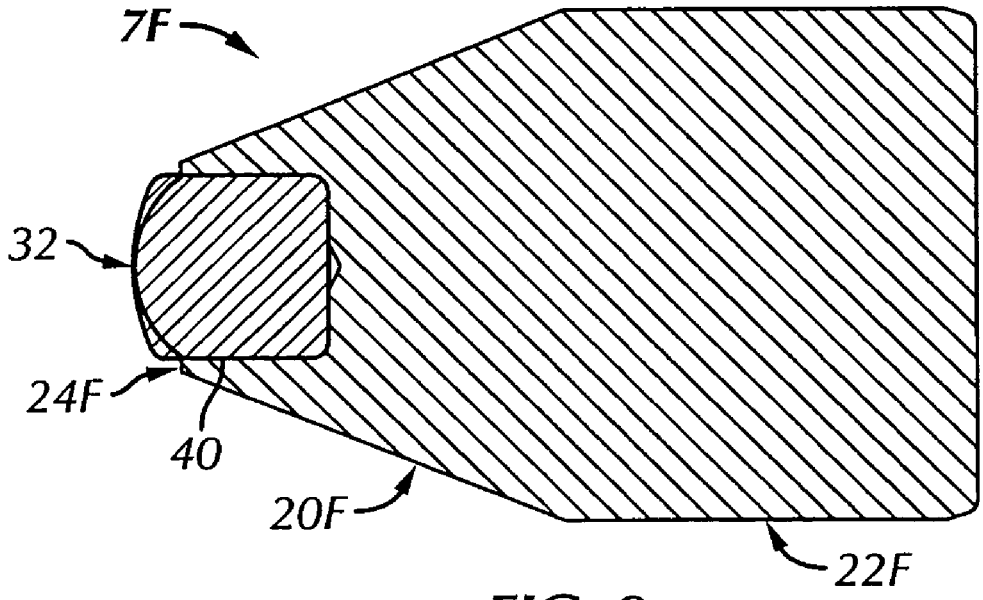
FIG. 8 shows another embodiment of a cutting element according to the aspect of the invention shown in one embodiment in FIG. 7.

An alternative embodiment of the insert shown in FIG. 7 is shown in FIG. 8. The insert 7F according to this embodiment includes a generally cylindrical body portion 22F and an extension portion 20F which terminates in an upper surface 24F, similar to other embodiments of the insert described herein. In this embodiment, the upper surface 24F includes therein a recess 40 in which is affixed a wafer 32. The wafer 32 in this embodiment can be substantially cylindrical, with a slightly convex outer surface as shown in FIG. 8, or with a planar outer surface. The wafer 32 can be made from any super hard material such as polycrystalline diamond, boron nitride or other super hard material known in the art. The extension portion 20F in this embodiment has a substantially flat profile, but may in some configurations include a concave part (not shown) such as shown in and described with respect to FIG. 2. As used in the description of this aspect of the invention, the term "wafer" is intended to include within its scope any structure which can be affixed, inserted into or otherwise coupled to the body of the insert so as to form at least a portion of the upper surface 24F of the insert 7F. The flat disk shown in FIG. 7 and the insert-type wafer in FIG. 8 are just two examples of a "wafer" according to this aspect of the invention.

Figure 9:
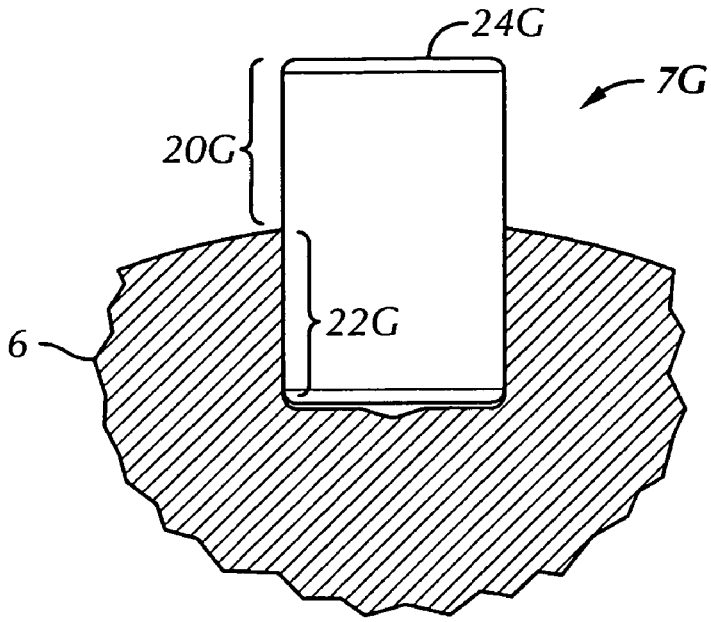
FIG. 9 shows an alternative configuration of a cutting element.

Another configuration of an insert for a single-cone bit according to the invention is shown in FIG. 9. This insert 7G includes a substantially cylindrical bottom portion 22G which is interference fit or otherwise affixed in a socket in the cone 6, as are the other inserts described herein. The insert 7G includes a substantially cylindrical extension portion 20G which terminates in a substantially planar upper surface 24G. The upper surface 24G in some embodiments may include thereon a diamond or other super hard material wafer (not shown in FIG. 9), in a manner similar to the embodiment of FIG. 6.

Figure 10:
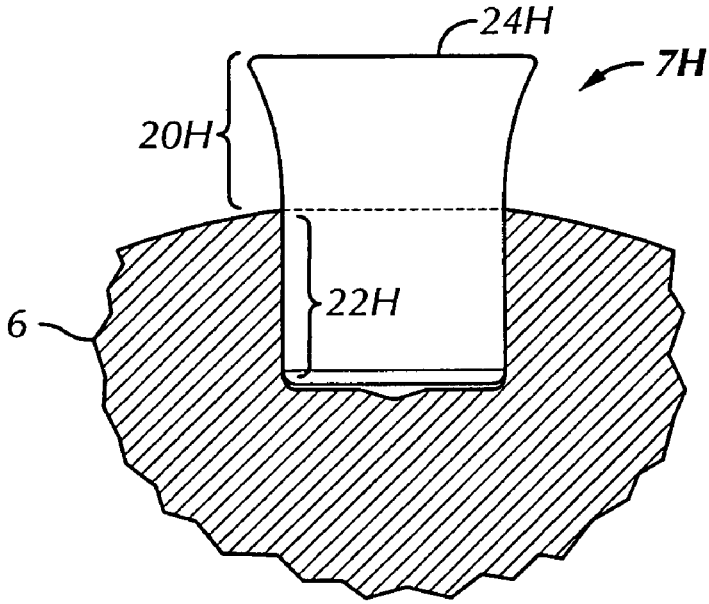
FIG. 10 shows an alternative configuration of a cutting element.
Figure 11A:
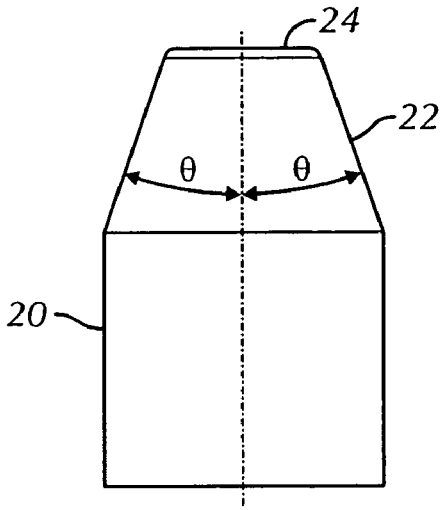
FIGS. 11A through 11D show an embodiment of a cutting element which has a variable cutting flank angle.
Figure 11B:
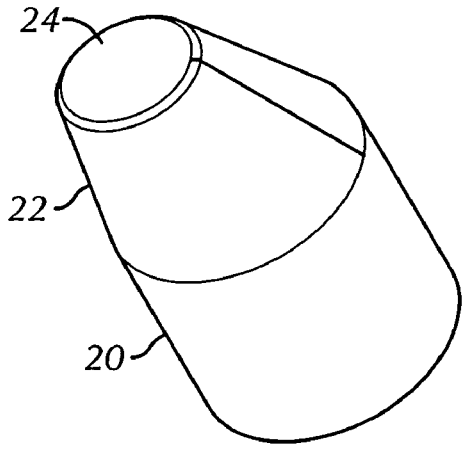
Figure 11C:
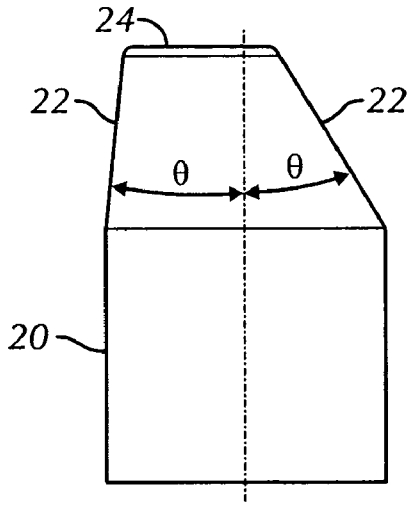
Figure 11D:
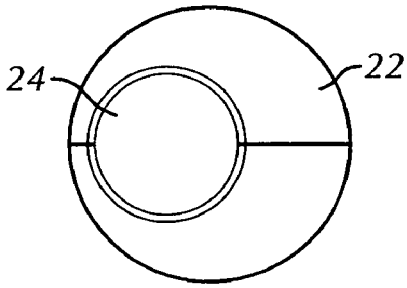

Another configuration of insert is shown at 7H in FIG. 10. This insert includes a substantially cylindrical bottom portion 22H which is affixed in the body of the cone 6, and a "reverse" tapered extension portion 20H which terminates in a substantially planar upper surface 24H. Reverse taper in this context means that the diameter of the upper surface 24H is larger than the diameter of the bottom portion 22H of the insert 7H. The embodiment of this insert provides for a large cutting flank inclination angle that is considered highly aggressive and efficient in shearing rock, but not as durable as a smaller inclination angle. The upper surface 24H in some embodiments may include thereon a diamond or other super hard material wafer (not shown in FIG. 10) similar to that shown in FIG. 6.

A single cone drill bit made according to this aspect of the invention may have improved ability to maintain full gage diameter while drilling over the useful life of the bit as compared with prior art bits.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit, comprising:

a bit body adapted to be coupled to a drill string;

a bearing journal depending from the bit body; and a single roller cone rotatably attached to the bearing journal, the roller cone having a plurality of inserts disposed at selected positions thereon, the journal defining a rotation angle with respect to an axis of rotation of the bit such that a plurality of inserts in a wall contact zone have an extension portion, extending substantially to gage diameter, and terminating in a substantially planar upper surface, and wherein the plurality of inserts comprise a cutting flank rake angle related to a rotary position about the plurality of inserts, wherein the cuffing flank rake angle is in a range between about 0 and 40 degrees.

2. The bit as defined in claim 1 wherein the extension portion of the at least one insert defines a tapered profile.

3. The bit as defined in claim 2 wherein at least part of the extension portion defines a concave profile, the concave profile part terminating near the upper surface.

4. The bit as defined in claim 3 wherein at least part of the extension portion defines a convex profile.

5. The bit as defined in claim 1 wherein the extension portion is substantially cylindrical.

6. The bit as defined in claim 1 wherein the extension portion of the at least one insert defines a reverse tapered profile.

7. The bit as defined in claim 1 wherein the extension portion and the upper surface define a substantially elliptical cross section.

8. The bit as defined in claim 1 wherein the upper surface has a super hard material wafer affixed thereto.

9. The bit as defined in claim 8 wherein the super hard material comprises at least one of polycrystalline diamond and boron nitride.

10. The bit as defined in claim 1 further comprising at least one gage protection pad affixed to the bit body.

11. The bit as defined in claim 1 wherein the at least one insert comprises tungsten carbide.

12. The bit as defined in claim 1 wherein a cutting flank inclination is between about 50 and 110 degrees.

13. The bit as defined in claim 12 wherein the cutting flank inclination is about 70 degrees.

14. The bit as defined in claim 1 wherein the substantially planar upper surface comprises a radius of curvature between about 25 and 50 percent of the wellbore diameter drilled by the bit.

15. The bit as defined in claim 1 wherein the substantially planar upper surface comprises a radius of curvature substantially equal to the radius of the wellbore diameter drilled by the bit.

16. The bit as defined in claim 1 wherein a juncture between the substantially planar surface and the extension portion forms a chamfer.

17. The bit as defined in claim 1 wherein a juncture between the substantially planar surface and the extension portion forms a radius of curvature of at most about 0.06 inches.

* * * * *